US008372206B2

(12) United States Patent
Gross et al.

(10) Patent No.: US 8,372,206 B2
(45) Date of Patent: Feb. 12, 2013

(54) HIGH POWER DENSITY ULTRASONIC FUEL CLEANING WITH PLANAR TRANSDUCERS

(75) Inventors: David J. Gross, Bethesda, MD (US); David Arguelles, Herndon, VA (US)

(73) Assignee: Dominion Engineering, Inc., Reston, VA (US)

( * ) Notice: Subject to any disclaimer, the term of this patent is extended or adjusted under 35 U.S.C. 154(b) by 305 days.

(21) Appl. No.: 12/353,950

(22) Filed: Jan. 14, 2009

(65) Prior Publication Data

US 2009/0241985 A1 Oct. 1, 2009

Related U.S. Application Data

(60) Provisional application No. 61/021,030, filed on Jan. 14, 2008, provisional application No. 61/058,767, filed on Jun. 4, 2008.

(51) Int. Cl.
*B08B 3/12* (2006.01)

(52) U.S. Cl. ..... 134/1; 134/184; 367/165

(58) Field of Classification Search ..... 134/1, 182, 134/184, 186; 367/163, 165, 166
See application file for complete search history.

(56) References Cited

U.S. PATENT DOCUMENTS 3,700,937 A * 10/1972 Rissolo ..... 310/337
4,118,649 A 10/1978 Shwartzman et al.
4,244,749 A 1/1981 Sachs et al.
4,375,991 A 3/1983 Sachs et al.
4,909,266 A * 3/1990 Massa ..... 134/60
4,966,177 A 10/1990 John, Jr. et al.
5,377,237 A 12/1994 Richardson et al.
5,383,484 A * 1/1995 Thomas et al. ..... 134/184
5,467,791 A * 11/1995 Kato et al. ..... 134/166 C
6,314,974 B1 11/2001 Schuler et al.
6,361,747 B1 * 3/2002 Dion et al. ..... 422/128
6,396,892 B1 5/2002 Frattini et al.
6,595,224 B2 * 7/2003 Miranda et al. ..... 134/186
7,542,539 B2 6/2009 Frattini et al.
2002/0195133 A1 * 12/2002 Miranda et al. ..... 134/186
2003/0062071 A1 4/2003 Sorbo et al.
2004/0256952 A1 12/2004 Puskas
2006/0107975 A1 5/2006 Arguelles et al.
2007/0002678 A1 1/2007 Murakami
2007/0160493 A1 * 7/2007 Ronholdt et al. ..... 422/20
2009/0252275 A1 10/2009 Hussey et al.
2011/0030741 A1 2/2011 Hasegawa et al.

OTHER PUBLICATIONS

International Preliminary Report on Patentability in related application PCT/US2009/031025 issued Jul. 20, 2010.
Written Opinion and International Search Report in related application PCT/US2009/031025 mailed Aug. 24, 2009.

* cited by examiner

*Primary Examiner* — Saeed T Chaudhry
(74) *Attorney, Agent, or Firm* — Pillsbury Winthrop Shaw Pittman LLP

(57) ABSTRACT

Provided are a range of ultrasonic cleaning assemblies that include radiating surfaces activated by corresponding arrays of planar transducers configured to increase the power applied to a reduced volume of fluid associated with a fuel assembly, thereby increasing that applied power density for improved cleaning. The individual ultrasonic cleaning assemblies may be arranged in a variety of modules that, in turn, may be combined to increase the length of the cleaning zone and provide variations in the power density applied to improve the cleaning uniformity.

23 Claims, 11 Drawing Sheets

HIGH POWER DENSITY ULTRASONIC FUEL CLEANING WITH PLANAR TRANSDUCERS

Pursuant to 35 U.S.C. §119(e), priority is claimed from U.S. Provisional Appl. Nos. 61/021,030, filed Jan. 14, 2008, and 61/058,767, filed Jun. 4, 2008, the contents of which are incorporated herein by reference, in their entirety.

BACKGROUND OF THE INVENTION

A number of ultrasonic cleaning systems have been developed for cleaning irradiated nuclear fuel assemblies including systems utilizing radial omni-directional ultrasonic cleaning technology as described, for example, in U.S. Pat. No. 6,396,892, the contents of which are incorporated herein by reference, in their entirety. FIG. 1 illustrates representative before and after photographs of fuel rods 100 in a fuel bundle cleaned using conventional radial omni-directional ultrasonic cleaning technology. Although, as reflected in FIG. 1, there is clear visual evidence of deposits being removed from the fuel assemblies, the cleaning is neither uniform nor complete, particularly with respect to the peripheral rods.

Comparing cleaning effectiveness data collected from field application of ultrasonic cleaning technology with cleaning effectiveness data collected in laboratory testing indicated that current fuel rod deposits are now exhibiting a dual-layer characteristic comprising both an outer layer that is relatively easy to remove and an inner layer that is much more tenacious. Further, laboratory tests performed by the inventors revealed that the rate of deposit removal achieved with ultrasonic cleaning varies non-linearly with the transducer power applied to the contaminated fuel rod. Accordingly, the deposit removal rate for a given deposit will be relatively low until a threshold ultrasonic power density ($P_T$) is reached, at which point the rate of deposit removal increases dramatically. Similarly, as the tenacity of the deposit increases, the threshold power density required to achieve efficient removal of the deposits increases.

As shown in FIG. 1, there are regions of the fuel where the deposits remained after cleaning with a conventional radial omni-directional ultrasonic cleaning technology. This uneven cleaning has been attributed, at least in part, to non-uniform ultrasonic power density within the cleaning zone. The pattern of clean and dirty regions suggests preferential cleaning in areas that are both aligned with the anti-nodes of the transducers (peak power locations) and exposed to ultrasonic energy from two faces. In these localized higher power density regions, the local power density exceeds the threshold ultrasonic power density ($P_T$) necessary to remove the deposits. It has been estimated that these localized higher power regions may achieve a local power density of approximately twice the bulk power density.

The power density realized at a given location within the cleaning zone depends on several factors, including 1) the total amount of energy output from the transducers, 2) the volume of water into which the ultrasonic energy is transmitted, 3) the degree to which the energy must pass through/around obstructions to get from the transducer to said surface to be cleaned, and 4) any local non-uniformity of the ultrasonic field. The first two factors, together, determine the bulk fluid power density (expressed in watts/gallon (or watts/liter)). Increasing the amount of power or reducing the volume of water results in an increase in the amount of ultrasonic energy (and subsequent cavitation) applied to the cleaning fluid and the surfaces immersed in the cleaning fluid. The third factor (presence or lack of obstructions) affects the distribution of energy within the bulk fluid volume.

As indicated in U.S. Pat. No. 5,467,791, the contents of which are incorporated herein by reference, in their entirety, and from the inventors' laboratory testing, a metallic membrane (such as a fuel channel or cleaning chamber flow guide) may reduce power density by as much as 50% inside the channel/flow guide relative to the power density achieved outside of membrane. The fourth factor (non-uniformity of field) results from localized differences in intensity on the radiating surfaces inherent with both planar and radial omni-directional transducers.

Prior art ultrasonic fuel cleaning systems use various techniques to achieve effective cleaning, including control of cleaning fluid properties, angled orientation of transducers, use of radial omni-directional transducers, and use of reflecting structures to guide energy to the cleaning zone. Although these techniques may provide some cleaning effectiveness benefit, none of the prior art configurations can achieve a power density above the cleaning threshold for the tenacious layer present in current fuel deposits. As shown in Appendix A, the estimated cleaning zone power density of prior art designs is 178 watts/gallon (47 watts/liter) (Kato et al.'s U.S. Pat. No. 5,467,791) and 112 watts/gallon (29.6 watts/liter) ((Frattini et al.'s U.S. Pat. No. 6,396,892) when cleaning a typical pressurized water reactor (PWR) fuel assembly (i.e., 10"×10" (25.4 cm×25.4 cm) cleaning zone). As will be appreciated, the design disclosed in the Kato patent is specifically tailored for cleaning channeled fuel assemblies (i.e., boiling water reactor (BWR) fuel) and the estimated power density for a PWR version of the Kato design is provided for comparison purposes only.

BRIEF SUMMARY

Example embodiments of the ultrasonic cleaning assembly according to the disclosure include arrays of planar transducers configured to increase the radiated power into a reduced volume of fluid associated with a fuel assembly, thereby achieving increased power density. The ultrasonic cleaning assembly may be arranged in a variety of modules that, in turn, may be combined to increase the length of the cleaning zone and provide variations in the power density applied to improve the cleaning uniformity.

BRIEF DESCRIPTION OF THE DRAWINGS

Example embodiments described below will be more clearly understood when the detailed description is considered in conjunction with the accompanying drawings, in which.

It should be noted that these Figures are intended to illustrate the general characteristics of methods, structure and/or materials utilized in certain example embodiments and to supplement the written description provided below. These drawings are not, however, drawn to scale and do not precisely reflect the precise structural or performance characteristics of any given embodiment and should not, therefore, be interpreted as defining or limiting the range of values or properties encompassed by example embodiments. Further, the drawings have been simplified by omitting peripheral structure including, for example, power supplies, cables, controllers and other equipment, with the understanding that those skilled in the art would be able to determine and configure the peripheral structure(s) and equipment necessary for the full range of embodiments disclosed herein and obvious variations thereof.

DETAILED DESCRIPTION

The inventors have determined that the tenacious layer currently associated with PWR fuel deposits has a threshold ultrasonic power density of approximately 200 watts/gallon (52.8 watts/liter) (as calculated using the methodology outlined below in Table 1). The invention consists of an ultrasonic cleaning device configured to achieve an ultrasonic power density on the order of 200 watts/gallon (52.8 watts/liter) or more. The invention utilizes arrays of planar transducers to achieve these high power densities rather than the conventional radial omni-directional transducers currently used for ultrasonic fuel cleaning.

Figure 2A:
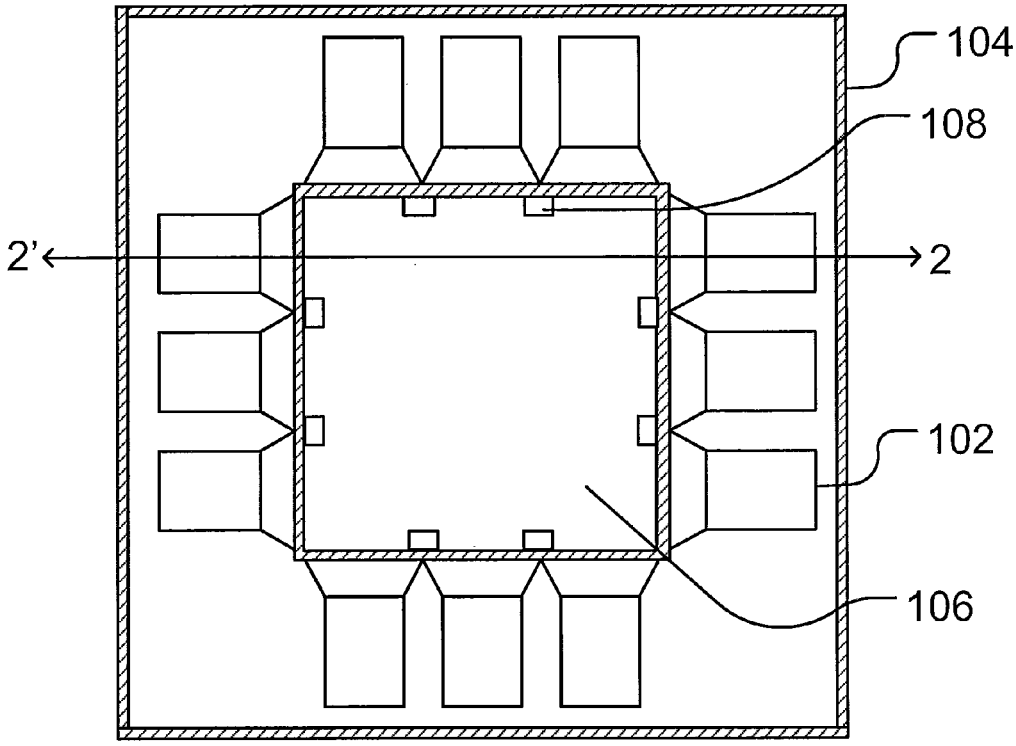
FIGS. 2A and 2B illustrate a first example embodiment of an ultrasonic cleaning assembly utilizing arrays of planar transducers.
Figure 2B:
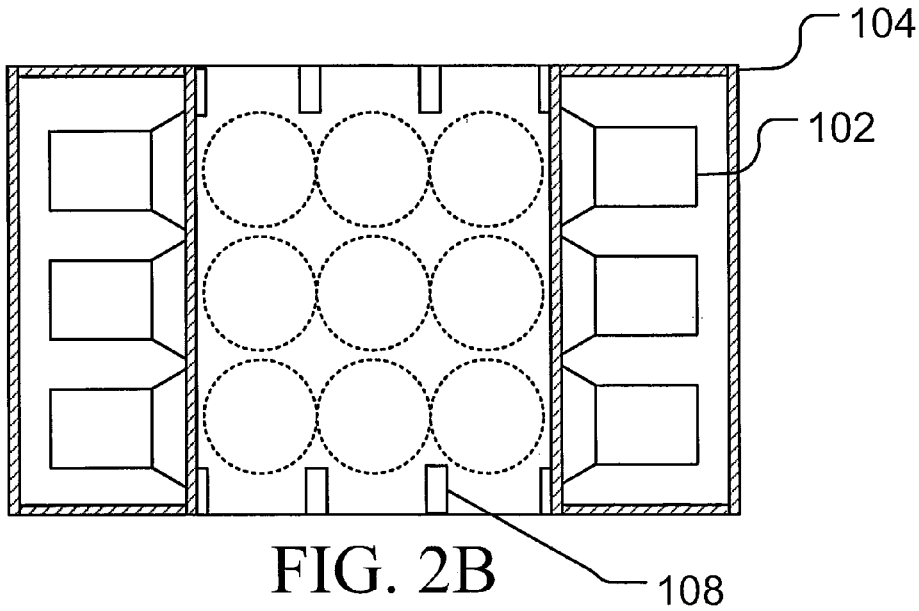

As illustrated in FIGS. 2A and 2B (a cross-section of FIG. 2A along line 2'-2), in a first example embodiment, the transducers 102 are provided in a modular assembly 104 and are arranged so that their radiating faces are directed toward and form a polygonal surface that encloses a central cleaning zone 106 that will limit the volume of fluid, the cleaning volume, that be present in the cleaning zone in combination with a fuel assembly and be activated by the radiating faces. As also illustrated in FIGS. 2A and 2B, additional frames, rails, rollers, guides, spacers or other mechanisms 108 may be provided within or adjacent the cleaning zone for centering the fuel bundle and/or preventing contact between the fuel bundle (not shown) with the radiating faces of the transducers.

As illustrated, the transducers within a particular array may be aligned vertically and/or horizontally. By selecting appropriate transducer modules and providing sufficient proportion of radiating surface, the illustrated transducer configuration applied to a limited cleaning volume has been able to produce a bulk power density of approximately 400 watts/gallon (105.7 watts/liter). This increased bulk power density overcomes localized variations in power level resulting from obstructions and refraction within the fuel bundle and still provides local power density sufficient to remove the more tenacious deposits.

Figure 11:
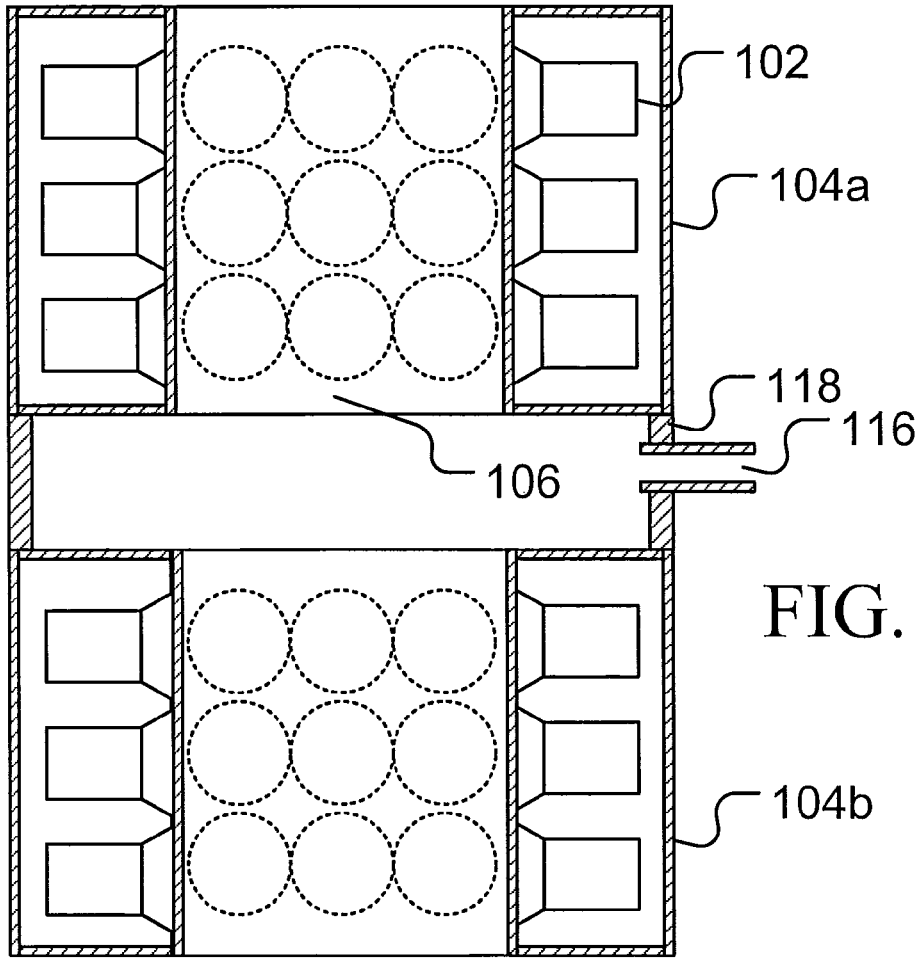

As will be appreciated, the configuration of the cleaning zone may be adapted for use with a number of fuel bundle arrangements. As illustrated in FIGS. 2A and 2B, the cleaning assembly 104 is open on both ends (although, in some configurations one end may be closed as illustrated in FIG. 11) and has a cross section that is only slightly larger than the outside dimensions of the fuel assembly to be cleaned. This allows the fuel assembly to be passed through the ultrasonic cleaning assembly or, conversely, allows the ultrasonic cleaning assembly to be moved along the fuel assembly to reduce the number of transducers required to clean the entire assembly and reduce the size, weight and power requirements of the ultrasonic cleaning assembly. Depending on the tolerance and precision that can be achieved by the mechanisms providing for the relative movement of the fuel assembly and ultrasonic cleaning assembly, the cleaning zone defined by the interior surfaces of the ultrasonic cleaning assembly should generally be configured to reduce the liquid volume within the cleaning zone while allowing free axial movement of the fuel assembly relative to the ultrasonic cleaning assembly.

Figure 3A:
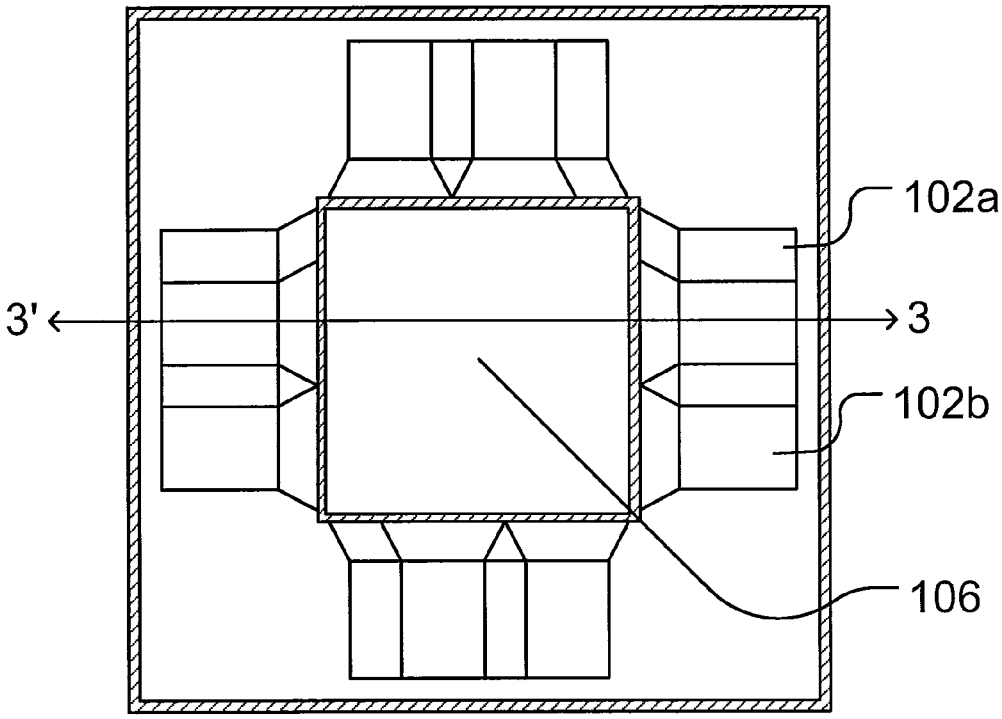
FIGS. 3A and 3B illustrate a second example embodiment of an ultrasonic cleaning assembly utilizing arrays of planar transducers.
Figure 3B:
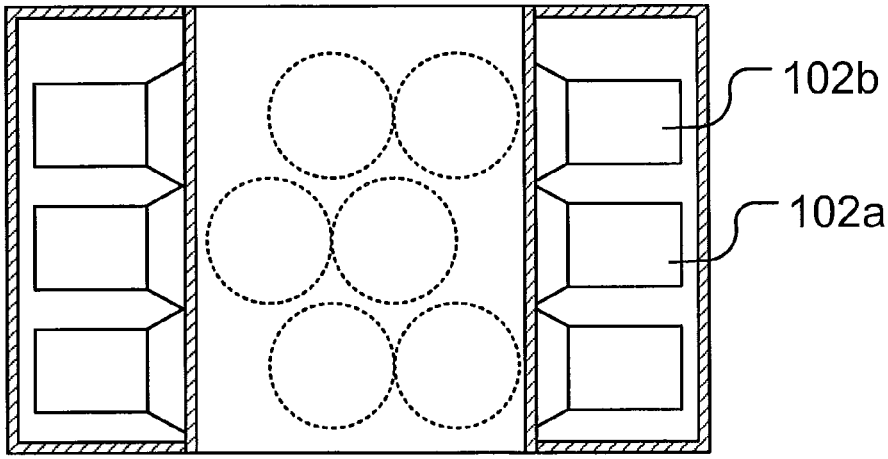

As illustrated in FIGS. 3A and 3B (a cross-section of FIG. 3A along line 3'-3), in a second example embodiment, the transducers 102*a*, 102*b* are provided in a modular assembly 104 and are arranged so that their radiating faces are directed toward an enclosed a central cleaning zone 106. As illustrated, however, the transducers within an array are configured with a horizontal offset relative to the adjacent row(s) of transducers. As will be appreciated, by using this offset configuration, the power density pattern within the cleaning zone will tend to reduce variation in the deposit removal pattern.

Figure 4:
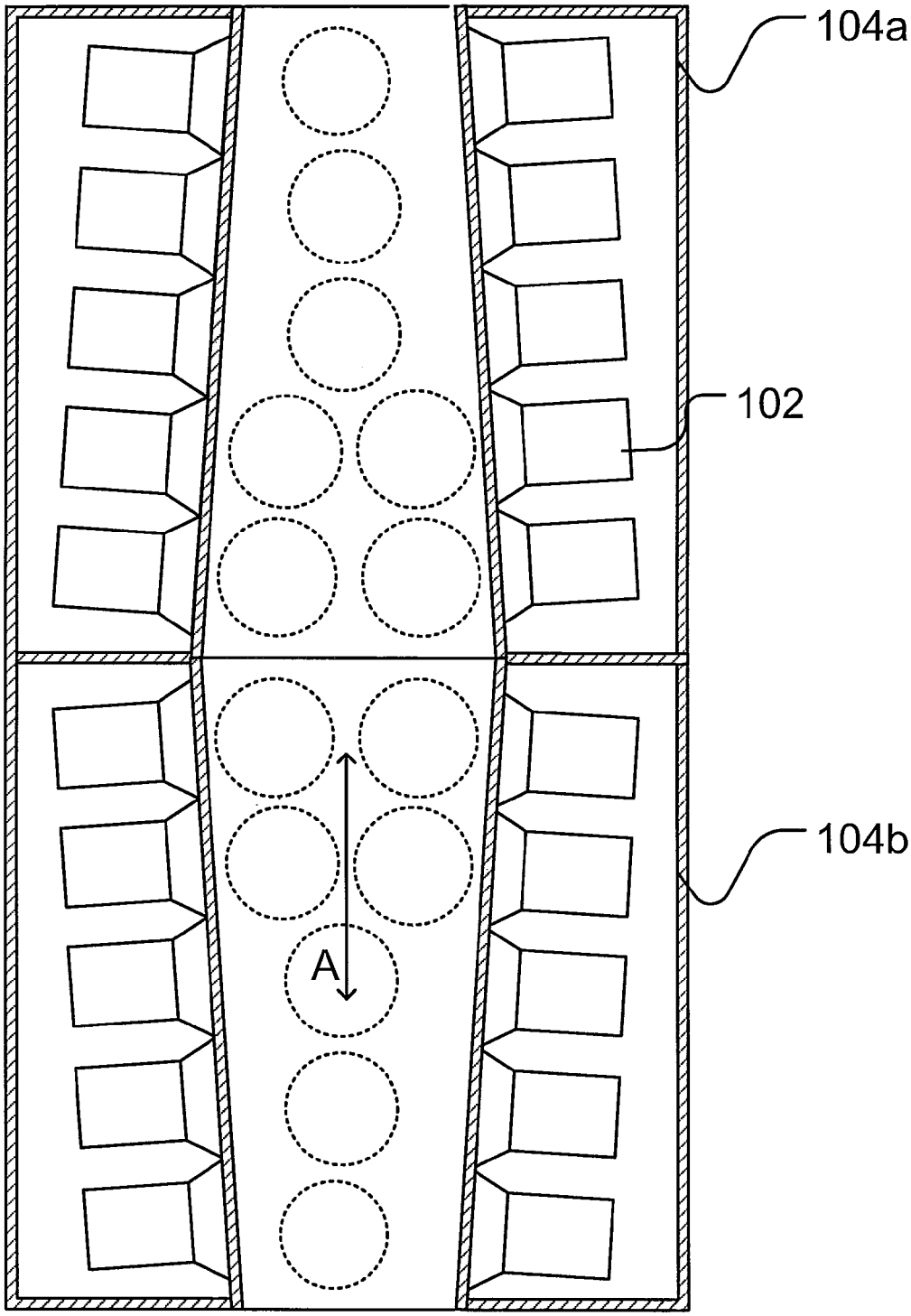
FIG. 4 illustrates a third example embodiment of an ultrasonic cleaning assembly utilizing arrays of planar transducers.

As illustrated in FIG. 4, in a third example embodiment, the transducers 102 are provided in a pair of modular ultrasonic cleaning assemblies 104*a*, 104*b* and are arranged so that their radiating faces are offset from a longitudinal axis A extending through the cleaning zone. As illustrated, two or more modular assemblies may be combined to provide an extended cleaning zone and/or to provide complementary power density patterns. As will be appreciated, the ultrasonic cleaning assembly modules that can be combined in this manner are not limited to assemblies configured for complementary cleaning patterns, but may, for example, include combination of differently configured modules, thereby tending to increase the overall cleaning performance.

Figure 5:
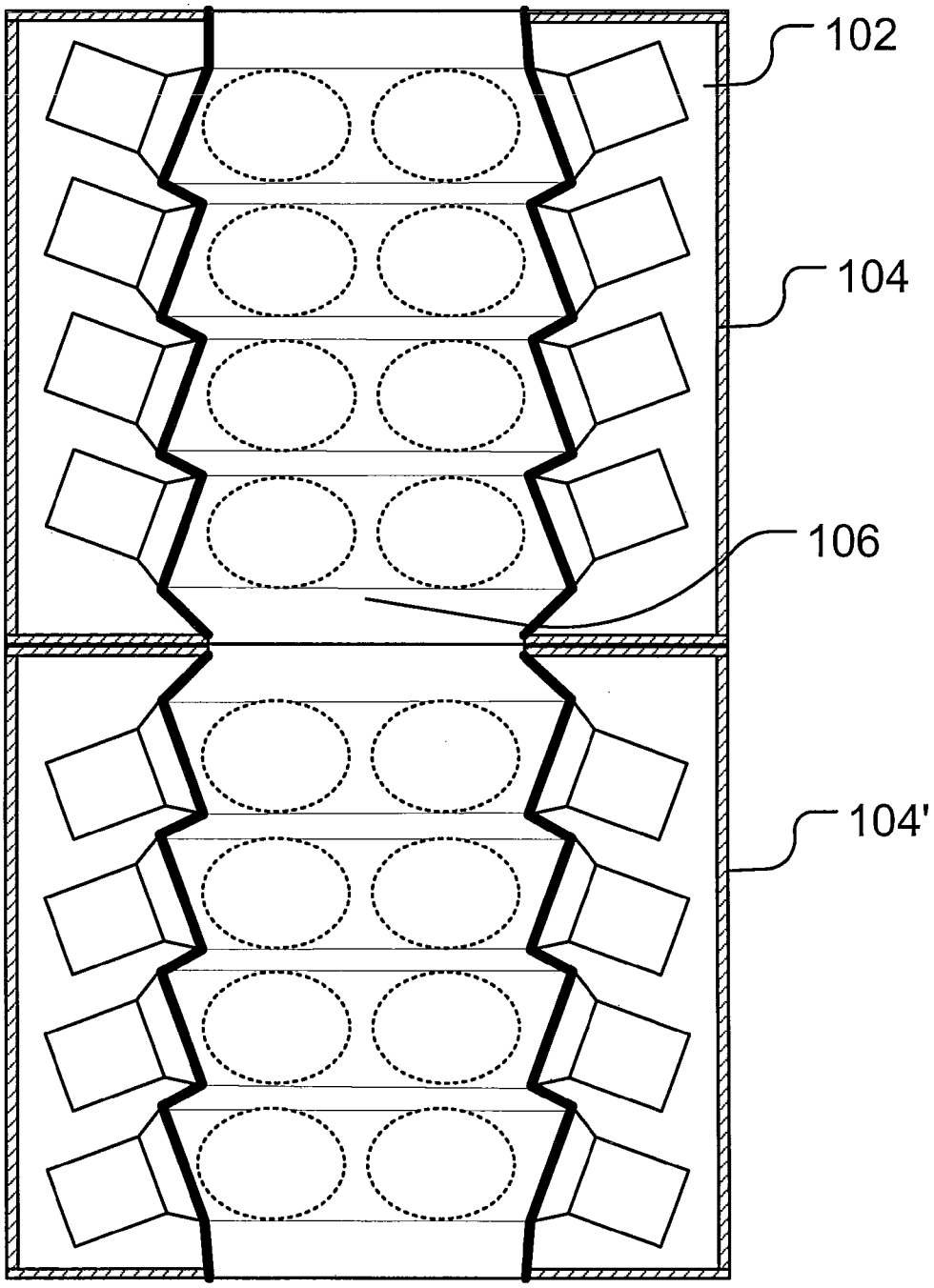
FIG. 5 illustrates a fourth example embodiment of an ultrasonic cleaning assembly utilizing arrays of planar transducers.

As illustrated in FIG. 5, in a fourth example embodiment, the transducers 102 are provided in a pair of modular ultrasonic cleaning assemblies 104*a*, 104*b* and are arranged so that their radiating faces are offset from a longitudinal axis A extending through the cleaning zone while still being vertically aligned, thereby maintaining a substantially uniform spacing between the radiating faces of the transducers 102 and a fuel assembly (not shown) moving through the cleaning zone.

Figure 6A:
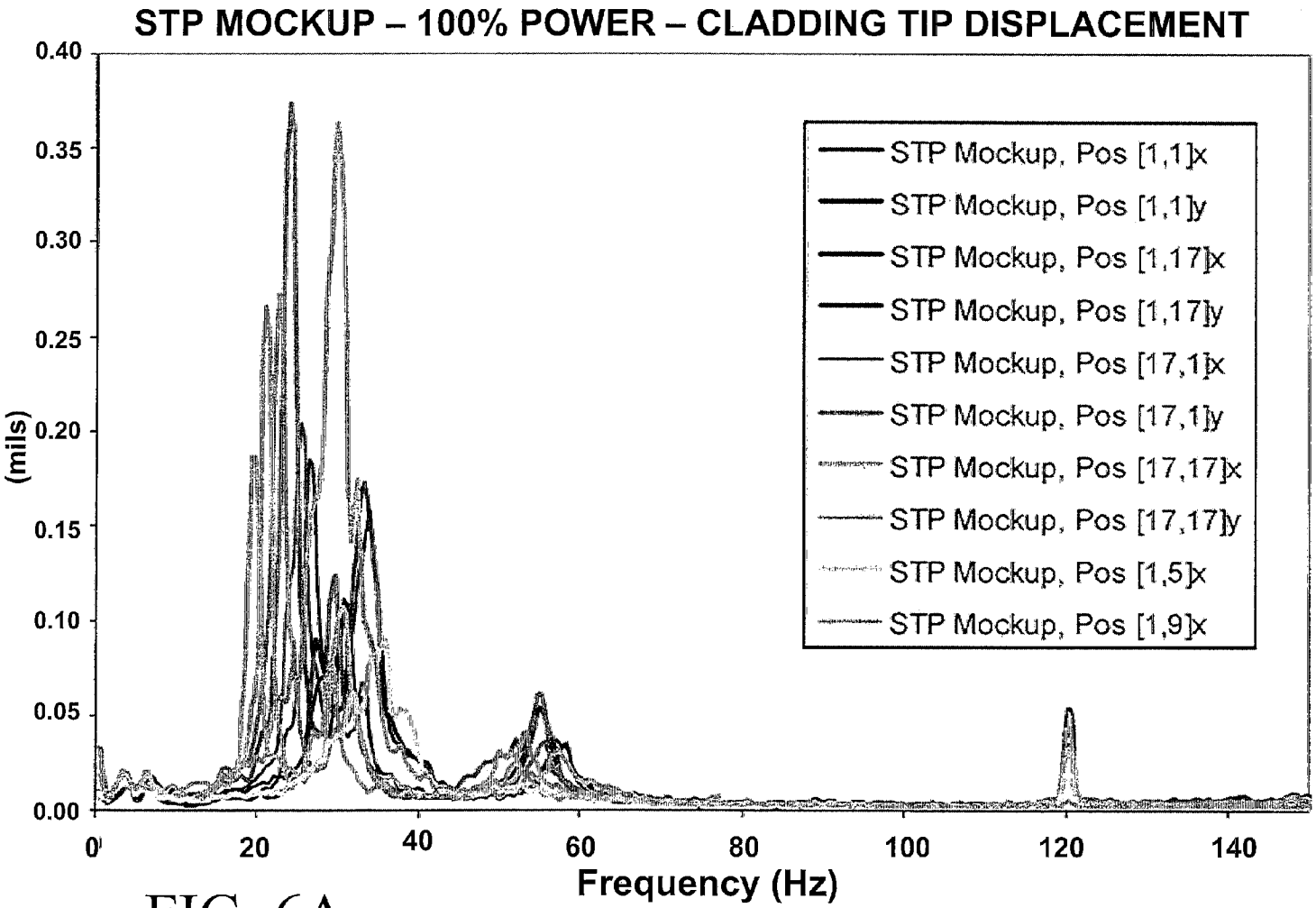
FIGS. 6A and 6B illustrate the displacement data collected from both a conventional (STP) radial omni-directional ultrasonic cleaning test assembly, FIG. 6A, and an ultrasonic cleaning assembly utilizing arrays of planar transducers, FIG. 6B.
Figure 6B:
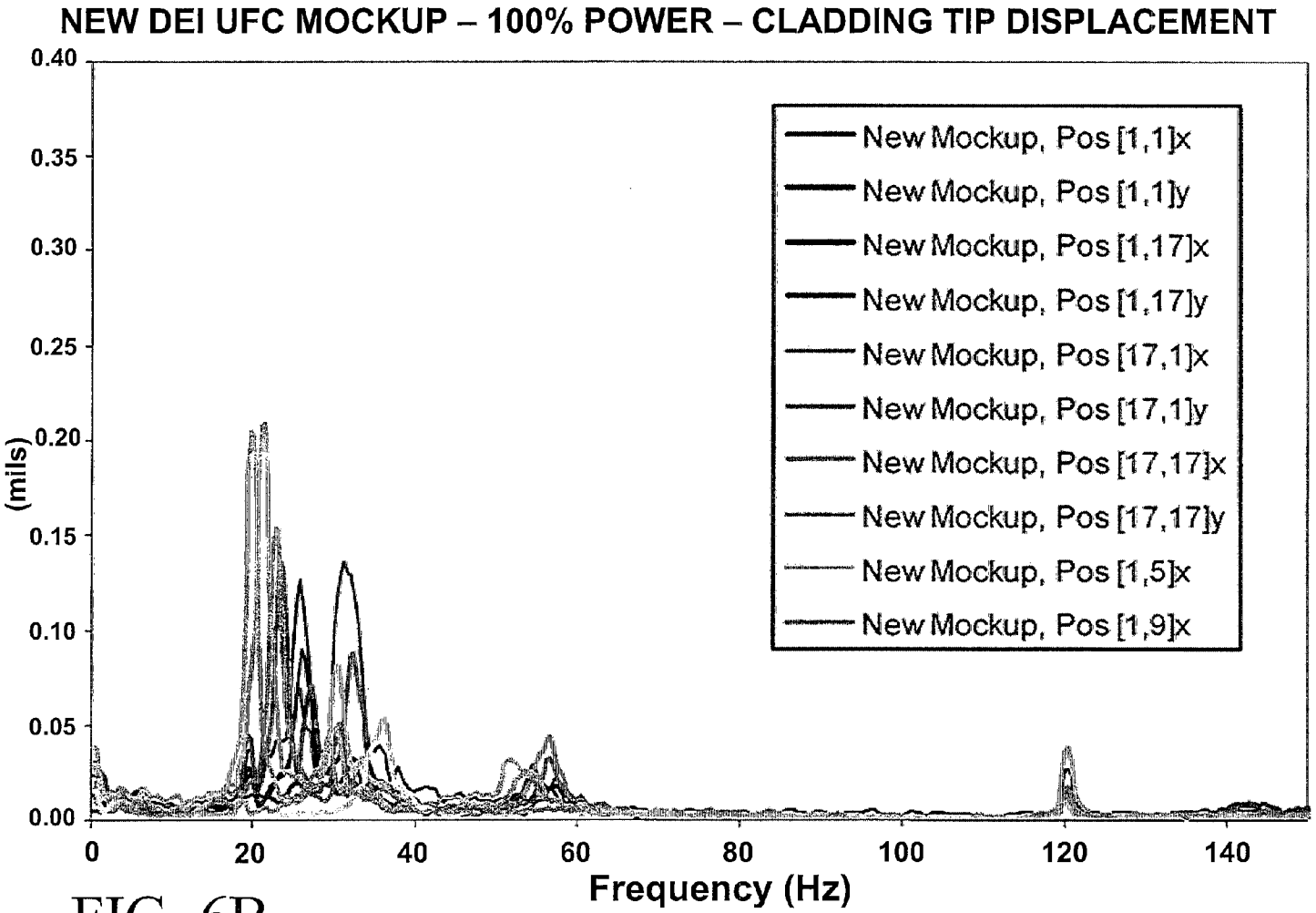
Figure 7:
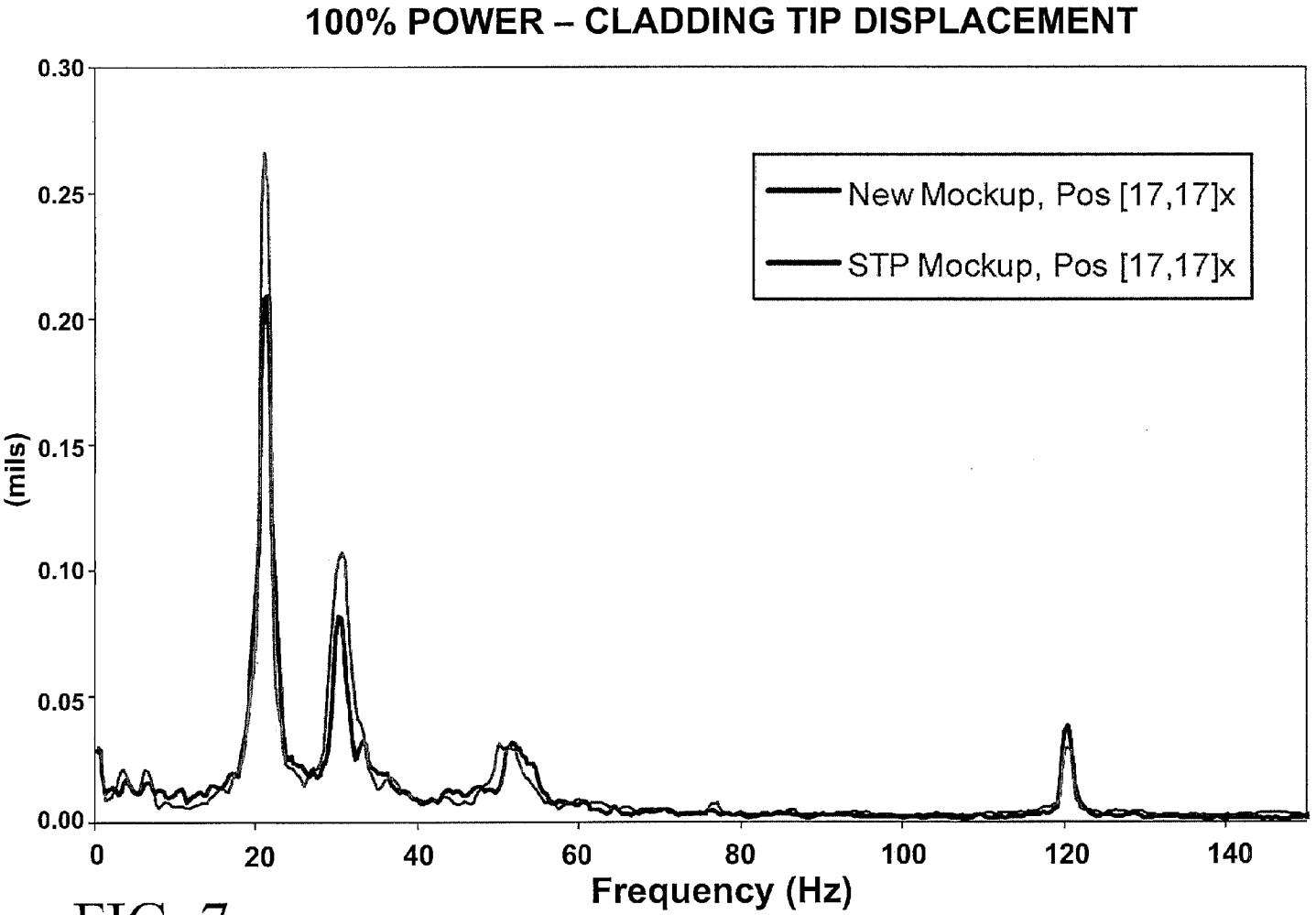
FIG. 7 illustrates a comparison of the displacement data for the conventional (STP) radial omni-directional ultrasonic cleaning test assembly and an ultrasonic cleaning assembly utilizing arrays of planar transducers.
Figure 8:
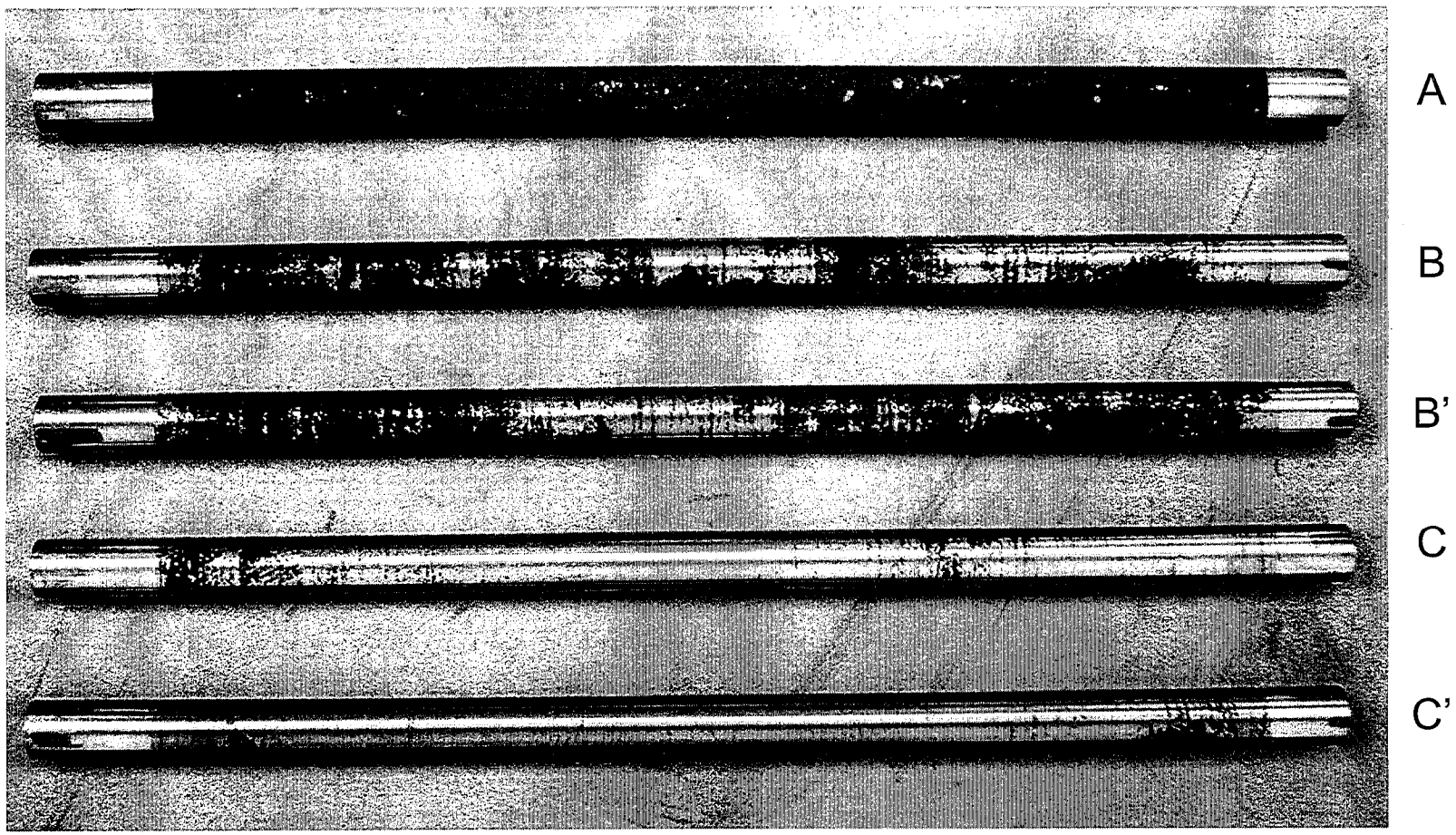
FIG. 8 illustrates test rods in an uncleaned state (A), as cleaned using a conventional (STP) radial omni-directional ultrasonic cleaning test assembly (B and B') and as cleaned using an ultrasonic cleaning assembly utilizing arrays of planar transducers (C and C')

As illustrated in FIGS. 6A, 6B and 7, experimental data indicates that despite the increased power density achieved with an ultrasonic cleaning assembly configured according to the disclosure, the measured vibration, i.e., the gross motion of the rods being subjected to the cleaning process is actually reduced relative to that experienced using conventional radial omni-directional transducers. Additional studies also indicate that an ultrasonic cleaning assembly configured according to the disclosure is capable of removing the more tenacious deposits without appreciable damage to the protective oxide film formed on the zirconium alloys commonly used for preparing the fuel assemblies.

Figure 9A:
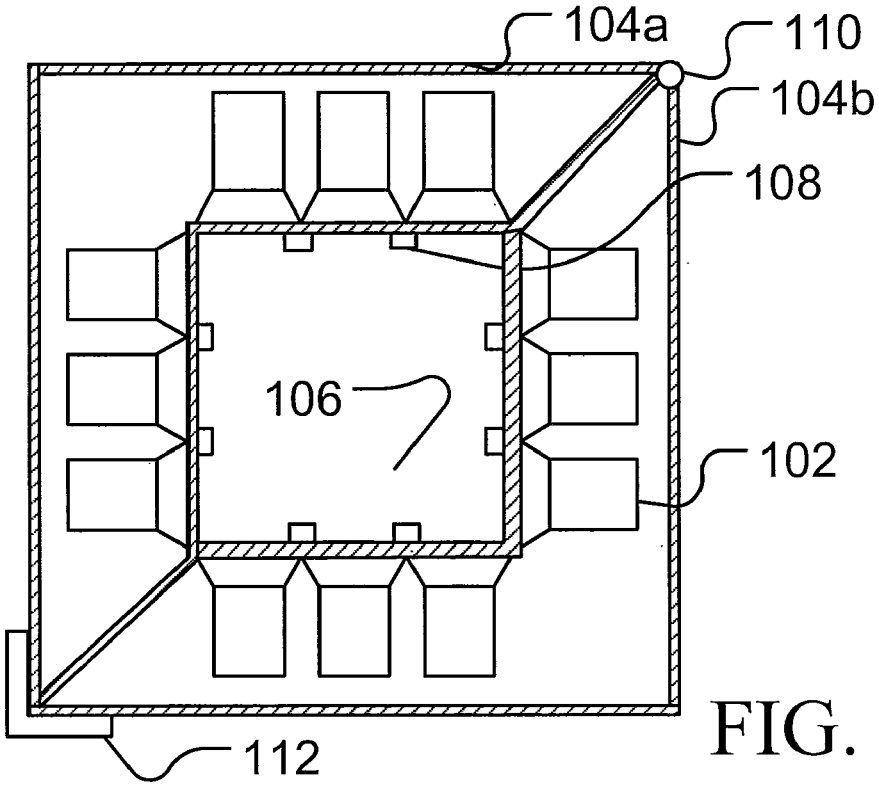
FIGS. 9A and 9B illustrate a fifth example embodiment of an ultrasonic cleaning assembly utilizing arrays of planar transducers.
Figure 9B:
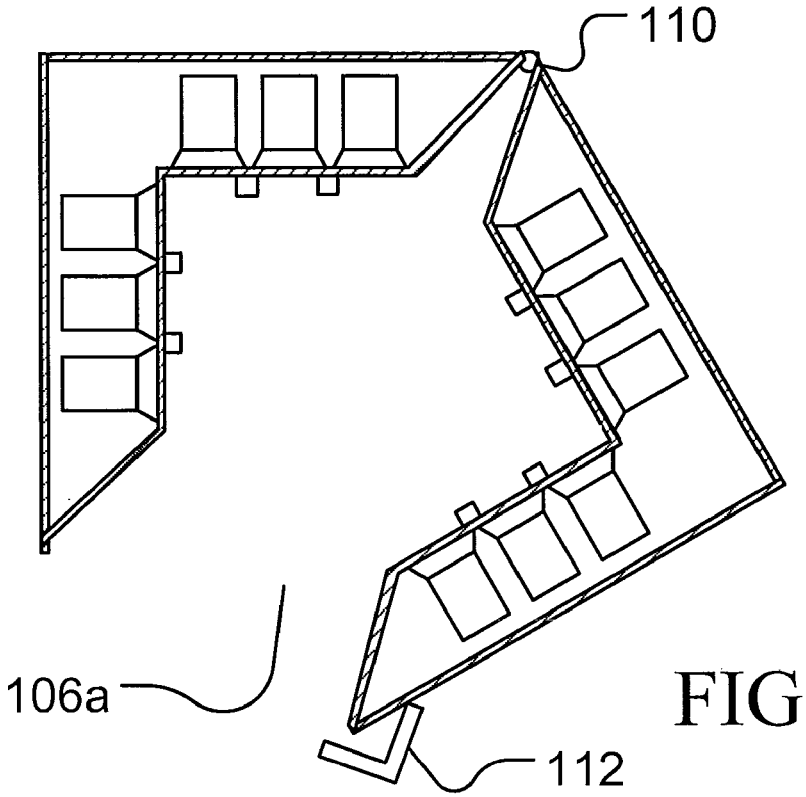

As illustrated in FIGS. 9A and 9B, the ultrasonic cleaning assembly may be provided with hinge 110 and latch 112 assemblies or suitable equivalents that will allow a first portion of the ultrasonic cleaning assembly to be moved relative to a second portion of the ultrasonic cleaning assembly. This relative movement may be used to provide an opening 106*a* through which the fuel bundle may enter the cleaning zone 106. Indeed, in combination with the guides 108, the act of closing the ultrasonic cleaning assembly will tend to guide the fuel bundle into the desired orientation within the ultrasonic cleaning assembly or, conversely, guide the ultrasonic cleaning assembly onto the fuel bundle.

Embodiments of the disclosed ultrasonic cleaning assemblies are configured with transducer arrays closely surrounding the cleaning zone for reducing the amount of ultrasonic energy that escapes from the cleaning assembly. Further, the reduced distance between the fuel rods and the transducer radiating faces reduces losses from attenuation while reducing the liquid volume enclosed in the cleaning zone, resulting in higher bulk and local power densities. The transducers and their radiating surfaces also function as a pressure boundary for directing fluid flow through cleaning zone, thereby eliminating the need for a separate flow guide between the transducers and the fuel. The lack of intervening structure between the fuel assembly and the transducers results in higher cleaning zone power density than that achieved by configurations in which the ultrasonic energy must pass through a separate flow guide to reach the fuel bundle being cleaned.

The ultrasonic cleaning assembly may also include one or more features including, for example, the formation of a varying power field within the cleaning zone whereby each portion of the fuel bundle is "cleaned" by different transducer configurations during insertion and removal of the fuel assembly. With the ultrasonic cleaning assembly operated in this manner, the surfaces of the fuel assembly will pass through different regions of locally varying power level and the overall cleaning uniformity would tend to improve. The piezoelectric driving heads in the planar transducers may also be arranged so that they are offset from a plane parallel to the axis of relative movement of the cleaning fixture/fuel assembly, again tending to improve cleaning uniformity.

The ultrasonic cleaning assembly may include additional mechanisms (not shown) to provide for the relative translation or offset of the transducers and/or fuel assembly during the cleaning operation in order to redistribute localized high power areas over the fuel surfaces. As discussed above, the radiating faces of the transducers and/or transducer assemblies may be angled so that the offset between the fuel assembly and transducer or transducer assembly radiating face varies along the axis of the cleaning fixture. Such an arrangement could distribute the localized high power spots in the cleaning zone to improve cleaning of interior fuel rods.

The ultrasonic cleaning assembly may be designed as a range of modules that form the integral structure of the cleaning fixture. Typically, each module would completely surround the cleaning zone with multiple modules being stacked to form an elongated cleaning zone of an appropriate length based on the length of the fuel being cleaned and/or the space available in which to conduct the cleaning. This design feature improves the flexibility of the ultrasonic cleaning assembly for cleaning different fuel assembly designs. Adjacent modules may have cooperating or complementary configurations of radiating faces to provide for improved cleaning.

As illustrated in FIGS. 2A and 2B and discussed above, the ultrasonic cleaning assembly may incorporate upper, lower, and/or intermediate guides for maintaining an offset between the radiating face of the transducers and the fuel bundle. This offset would tend to prevent or reduce contact between the fuel and the vibrating transducer face, and would reduce the amount of contamination buildup on the transducers.

Figure 10:
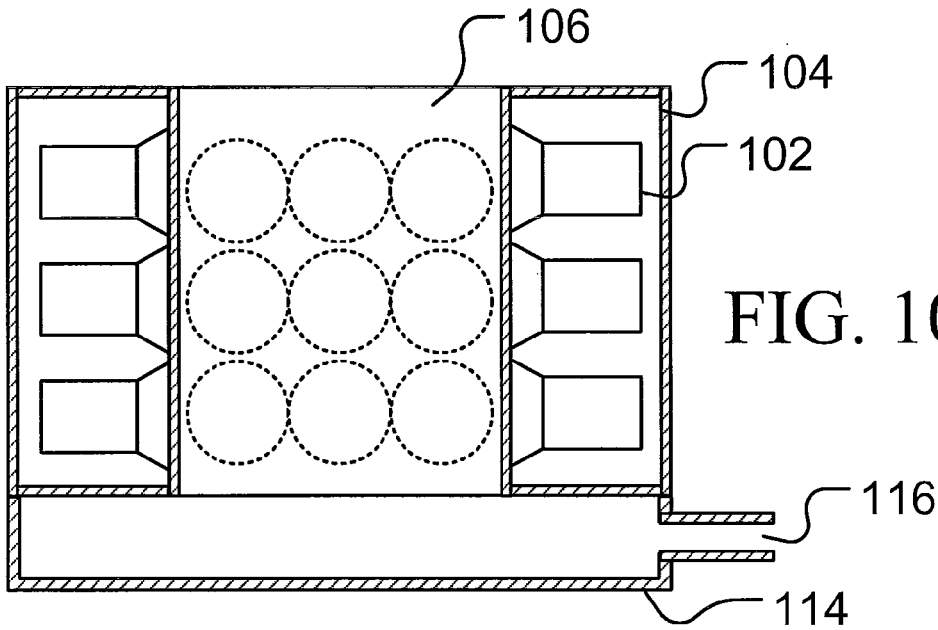
FIGS. 10 and 11 illustrate sixth and seventh example embodiments, respectively, of an ultrasonic cleaning assembly utilizing arrays of planar transducers with modifications providing for pump attachment for removing deposits dislodged by the ultrasonic cleaning process.

As illustrated in FIG. 10, the ultrasonic cleaning assembly may include an open top 106 and an enclosed lower region 114 which is provided with one or more a suction ports 116 so that water from the pool would be drawn through the cleaning zone to sweep away dislodged deposits and to maintain a clean volume of cleaning fluid (pool water) in the cleaning zone.

As illustrated in FIG. 11, the ultrasonic cleaning assembly may include an open top and an open bottom with a space region 118 providing for one or more intermediate suction ports 116 with cleaning zones provided both above and below. Water from the pool would be drawn through the cleaning zone from the top and bottom openings to sweep away dislodged deposits and to maintain a clean volume of cleaning fluid (pool water) in the cleaning zone. Such an arrangement would allow for a shorter overall length for the ultrasonic cleaning assembly.

Figure 1:
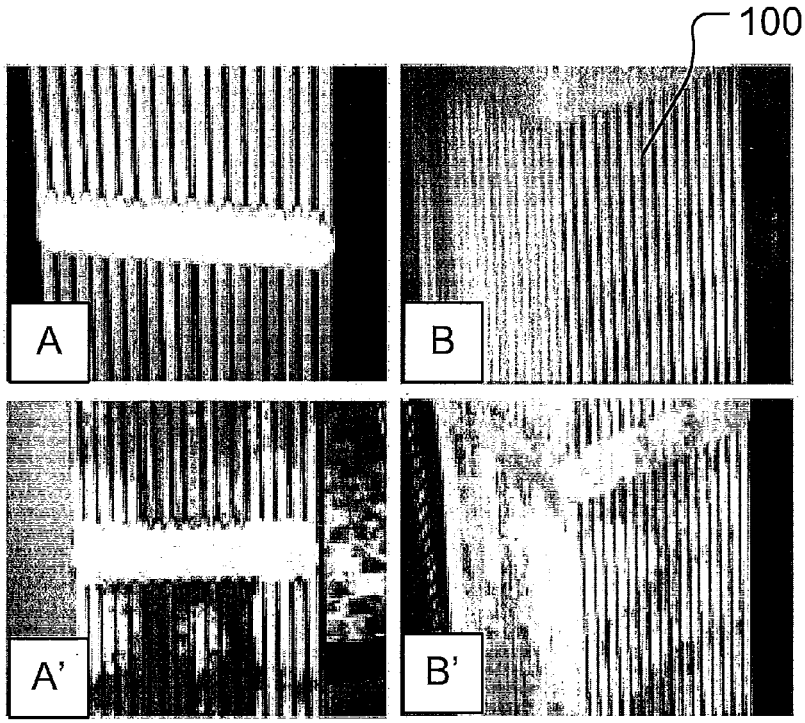
FIG. 1 (CONVENTIONAL ART)
FIG. 1 illustrates the uneven cleaning results achieved using conventional utilizing radial omni-directional ultrasonic cleaning technology.
Figure 12:
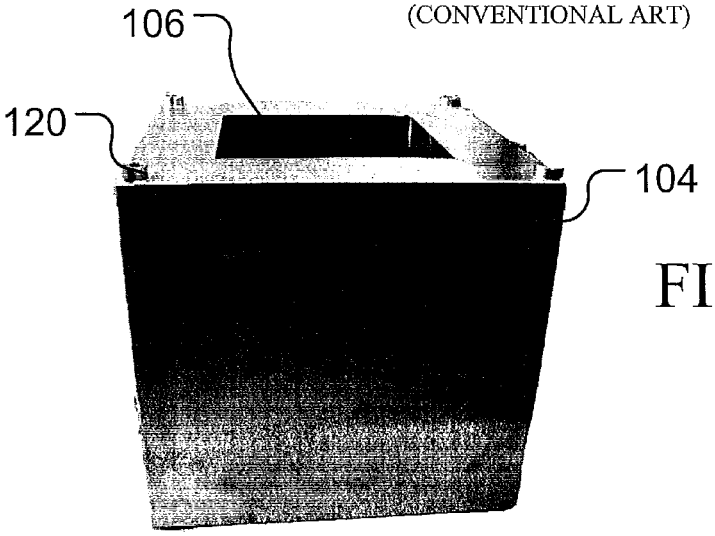
FIG. 12 illustrates an example embodiment of an ultrasonic cleaning assembly utilizing arrays of planar transducers constructed for evaluation and testing.

As illustrated in FIG. 12, an embodiment of an ultrasonic cleaning assembly utilizing arrays of planar transducers generally consistent with the construction illustrated in FIGS. 2A and 2B, was constructed for evaluation and testing purposes. The enclosure 104 defined the cleaning zone 106 (in this instance, rectangular) and provides fixtures 120 that can cooperate with corresponding fixtures (not shown) provided on the bottom of an adjacent ultrasonic cleaning assembly for stacking corresponding modules (not shown) to produce an elongated cleaning zone.

As illustrated in FIGS. 9A and 9B and discussed above, the ultrasonic cleaning assembly may have one (not shown) or two sides of the cleaning zone that can open relative to the rest of the assembly and close to allow fuel to enter the cleaning zone from the side instead of from the top. Further, because the cleaning zone is defined by the radiating surfaces, the profile is not limited to any particular geometric shape and may be configured to accommodate different fuel bundle arrangements (e.g., triangular, rectangular, square or hexagonal).

While the disclosed ultrasonic cleaning assemblies have been particularly shown and described with reference to example embodiments thereof, the invention should not be construed as being limited to the particular embodiments set forth herein; rather, these example embodiments are provided to convey more fully the concept of the invention to those skilled in the art. Thus, it will be apparent to those of ordinary skill in the art that various changes in form and details may be made therein without departing from the spirit and scope of the inventions as defined by the following claims.

TABLE 1

| Average Ultrasonic Power Densities of Various Fuel Cleaner Designs | |
|---|---|
| Estimated Power Density of Planar BWR Cleaner (Proposed High Power Design) | |
| Assumptions | |
| 50% | Transmission of energy through wall (BWR fuel channel) |
| Input Data | |
| 2800 | (watts) Power per transducer pitch in BWR Cleaner |
| 16 | (inches) transducer pitch/height |

TABLE 1-continued

| Average Ultrasonic Power Densities of Various Fuel Cleaner Designs | |
|---|---|
| 10 | (inches) ID of square cleaning zone |
| 6 | (inches) OD of square fuel channel (cleaning zone) |
| Calculated Values | |
| 4.4 | (gallons) water volume outside channel per transducer pitch |
| 2.5 | (gallons) water volume inside channel per transducer pitch |
| 2185 | (watts) total power outside cleaning zone |
| 615 | (watts) total power inside cleaning zone |
| 493 | (watts/gal) power density outside box |
| 247 | (watts/gal) power density inside box (assuming transmission % above) |
| | Calculated Power Density of Existing BWR Cleaner (Radial Omni-directional Design) |
| Assumptions | |
| 50% | Transmission of energy through wall (BWR fuel channel) |
| Input Data | |
| 6000 | (watts) Power per transducer pitch in PWR Cleaner (4 × 1500 w) |
| 31.5 | (inches) transducer pitch/height |
| 13.35 | (inches) ID of reflector |
| 6 | (inches) OD of square fuel channel (cleaning zone) |
| Calculated Values | |
| 14.2 | (gallons) water volume outside box tube per pitch |
| 4.9 | (gallons) water volume inside box tube per pitch |
| 5115 | (watts) total power outside cleaning zone |
| 885 | (watts) total power inside cleaning zone |
| 361 | (watts/gal) power density outside box |
| 180 | (watts/gal) power density inside box (assuming transmission % above) |
| | Estimated Power Density of Kato Cleaner (BWR Fuel) |
| General Assumptions | |
| 50% | Transmission through channel box |
| 4.4 | (watts/in^2) Planar transducer power output (assumed equal to transducers used above) |
| Geometry Assumptions | |
| 6.0 | (inches) Channel box width |
| 3.94 | (inches) Transducer Offset Distance (Kato FIGS. 10, 11) |
| 13.87 | (inches) Octagon Diameter of enclosed water volume |
| 5.75 | (inches) Transducer width |
| 16.00 | (inches) Transducer pitch/height |
| 8 | Max number of transducers at any elevation (Kato FIG. 6, 7) |
| Calculated Values | |
| 402.5 | (watts) Individual Transducer Power (from assumed geometry and assumed power output) |
| 3220 | (watts) Power per transducer pitch with max number of transducers |
| 2.5 | (gallons) water volume inside box tube per pitch |
| 8.6 | (gallons) water volume outside box tube per pitch |
| 2810 | (watts) total power outside cleaning zone |
| 410 | (watts) total power inside cleaning zone |
| 329 | (watts/gal) power density outside box |
| 164 | (watts/gal) power density inside box (assuming transmission % above) |
| | Estimated Power Density of Planar PWR Cleaner (Proposed High Power Design) |
| Assumptions | |
| 100% | Transmission of energy through wall (No fuel channel) |
| Input Data | |
| 2800 | (watts) Power per transducer pitch in PWR Cleaner |
| 16 | (inches) transducer pitch/height |
| 10 | (inches) ID of square cleaning zone |
| Calculated Values | |
| 6.9 | (gallons) water volume per transducer pitch |
| 404 | (watts/gal) power density inside cleaning zone |
| | Calculated Power Density of Existing PWR Cleaner (Radial Omni-directional Design) |
| Assumptions | |
| 50% | Transmission of energy through wall (cleaning chamber flow guide) |

TABLE 1-continued

| Average Ultrasonic Power Densities of Various Fuel Cleaner Designs | |
|---|---|
| Input Data | |
| 6000 | (watts) Power per transducer pitch in PWR Cleaner (4 × 1500 w) |
| 31.5 | (inches) transducer pitch/height |
| 17.35 | (inches) ID of reflector |
| 9 | (inches) ID of square cleaning zone |
| Calculated Values | |
| 21.2 | (gallons) water volume outside box tube per pitch |
| 11.0 | (gallons) water volume inside box tube per pitch |
| 4760 | (watts) total power outside cleaning zone |
| 1240 | (watts) total power inside cleaning zone |
| 225 | (watts/gal) power density outside box |
| 112 | (watts/gal) power density inside box (assuming transmission % above) |
| | Estimated Power Density of Kato Cleaner (PWR Fuel) |
| General Assumptions | |
| 50% | Transmission through channel box |
| 4.4 | (watts/in^2) Planar transducer power output (assumed equal to transducers used above) |
| Geometry Assumptions | |
| 10.0 | (inches) Channel box width |
| 3.94 | (inches) Transducer Offset Distance (Kato FIGS. 10, 11) |
| 17.87 | (inches) Octagon Diameter of enclosed water volume |
| 7.41 | (inches) Transducer width |
| 16.00 | (inches) Transducer pitch/height |
| 8 | Max number of transducers at any elevation (Kato FIG. 6, 7) |
| Calculated Values | |
| 518.7 | (watts) Individual Transducer Power (from assumed geometry and assumed power output) |
| 4150 | (watts) Power per transducer pitch with max number of transducers |
| 6.9 | (gallons) water volume inside box tube per pitch |
| 11.4 | (gallons) water volume outside box tube per pitch |
| 3183 | (watts) total power outside cleaning zone |
| 966 | (watts) total power inside cleaning zone |
| 279 | (watts/gal) power density outside box |
| 140 | (watts/gal) power density inside box (assuming transmission % above) |

We claim:

1. A submersible ultrasonic cleaning assembly comprising:

an array of planar ultrasonic transducers applied to a first plurality of pressure walls to form a plurality of radiating surfaces, the radiating surfaces being arranged to form an interior of a polygonal opening defining a cleaning zone that is adapted to receive at least part of an object to be cleaned and liquid in which said at least part of the object to be cleaned is immersed, wherein, during cleaning of said at least part of the object, the pressure walls on which the array of planar ultrasonic transducers is applied define an interface between the transducers and said liquid; and a second plurality of pressure walls cooperating with the first plurality of pressure walls to enclose the transducers, wherein the ultrasonic cleaning assembly is constructed and arranged to be submersible.

2. The submersible ultrasonic cleaning assembly of claim 1, wherein, during cleaning of said at least part of the object, said first plurality of pressure walls function as a pressure boundary to direct a flow of said liquid through the cleaning zone to said at least part of the object to be cleaned.

3. The submersible ultrasonic cleaning assembly of claim 1, wherein the array of transducers comprises a plurality of rows of transducers and wherein, transducers in a row are arranged with a horizontal offset relative to an adjacent row of transducers.

4. The submersible ultrasonic cleaning assembly of claim 1, wherein the transducers are applied to the first plurality of pressure walls so that their radiating faces are offset from a longitudinal axis extending through the cleaning zone.

5. The submersible ultrasonic cleaning assembly of claim 4, wherein the transducers are vertically aligned so that, during cleaning of said at least part of the object, a substantially uniform spacing is maintained between the radiating faces of the transducers and said at least part of the object.

6. The submersible ultrasonic cleaning assembly of claim 1, comprising a hinge assembly that allows a first portion of the planar ultrasonic transducers to be moved relative to a second portion of planar ultrasonic transducers.

7. The submersible ultrasonic cleaning assembly of claim 6, wherein the hinge assembly is arranged on the second plurality of pressure walls.

8. The submersible ultrasonic cleaning assembly of claim 7, comprising a latch assembly configured to latch the first portion of the planar ultrasonic transducers to the second portion of the planar ultrasonic transducers.

9. The submersible ultrasonic cleaning assembly of claim 1, wherein the planar ultrasonic transducers are applied to the first plurality of pressure walls such that each portion of said at least part of the object to be cleaned is treated by different transducer configurations during insertion and removal of said at least part of the object into and from the cleaning zone.

10. The submersible ultrasonic cleaning assembly of claim 1, comprising one or more guides for maintaining an offset between the pressure walls and said at least part of the object.

11. The submersible ultrasonic cleaning assembly of claim 1, comprising an open region to receive said at least part of the object to be cleaned and an enclosed lower region.

12. The submersible ultrasonic cleaning assembly of claim 11, wherein the enclosed lower region is provided with one or more suction ports to sweep away dislodged deposits and to maintain a clean volume of liquid in the cleaning zone.

13. The submersible ultrasonic cleaning assembly of claim 1, wherein the cleaning zone includes two distinct cleaning regions that are spaced away from each other.

14. The submersible ultrasonic cleaning assembly of claim 13, wherein a first cleaning region is defined by a first plurality of the planar ultrasonic transducers and a second cleaning region is defined by a second plurality of the planar ultrasonic transducers, wherein a space region devoid of planar ultrasonic transducers is provided between the first and the second cleaning regions.

15. The submersible ultrasonic cleaning assembly of claim 14, wherein the space region includes one or more suction ports to sweep away dislodged deposits and to maintain a clean volume of liquid in the cleaning zone.

16. The submersible ultrasonic cleaning assembly of claim 1, wherein, during cleaning of said at least part of the object, at least part of the second plurality of pressure walls is immersed in liquid.

17. The submersible ultrasonic cleaning assembly of claim 1, wherein, during cleaning of said at least part of the object, the planar ultrasonic transducers are configured to apply ultrasonic agitation to the liquid such that the cleaning zone has a bulk energy density of at least 200 watts/gallon.

18. A method of ultrasonic cleaning comprising:

configuring an array of planar ultrasonic transducers to form a radiating surface;

arranging a plurality of radiating surfaces to form a cleaning module having a polygonal opening defining a cleaning zone;

maintaining a volume of liquid within the polygonal opening;

applying ultrasonic agitation to the liquid to form a cleaning zone having a bulk energy density of at least 200 watts/gallon; and moving a contaminated object through the cleaning zone, wherein the array of planar ultrasonic transducers is encapsulated between two walls of the cleaning module and said cleaning module is constructed and arranged to be submersible in liquid during cleaning of the object.

19. A submersible ultrasonic cleaning assembly comprising:

an array of planar ultrasonic transducers applied to a first plurality of pressure walls to form a plurality of radiating surfaces, the radiating surfaces being arranged to form an interior of a polygonal opening defining a cleaning zone that is adapted to receive at least part of an object to be cleaned and liquid in which said at least part of the object to be cleaned is immersed, wherein, during cleaning of said at least part of the object, (a) the pressure walls on which the array of planar ultrasonic transducers is applied define an interface between the transducers and said liquid and (b) said liquid is in contact with both the first plurality of pressure walls and said at least part of the object;

a second plurality of pressure walls cooperating with the first plurality of pressure walls to enclose the transducers so that the planar ultrasonic transducers are encapsulated between the first plurality of pressure walls and the second plurality of pressure walls, said first and second plurality of pressure walls being submersible in said liquid during cleaning of said at least part of the object, wherein the transducers are arranged in a plurality of rows of transducers around said cleaning zone and along a longitudinal axis extending through said cleaning zone, and wherein transducers within a row are arranged with a horizontal offset relative to an adjacent row of transducers.

20. The submersible ultrasonic cleaning assembly of claim 19, comprising a hinge assembly that allows a first portion of the planar ultrasonic transducers to be moved relative to a second portion of planar ultrasonic transducers.

21. The submersible ultrasonic cleaning assembly of claim 20, wherein the hinge assembly is arranged on the second plurality of pressure walls.

22. The submersible ultrasonic cleaning assembly of claim 21, comprising a latch assembly configured to latch the first portion of the planar ultrasonic transducers to the second portion of the planar ultrasonic transducers.

23. The submersible ultrasonic cleaning assembly of claim 19, wherein, during cleaning of said at least part of the object, the planar ultrasonic transducers are configured to apply ultrasonic agitation to the liquid such that the cleaning zone has a bulk energy density of at least 200 watts/gallon.

* * * * *